US009291088B2

(12) United States Patent
Han

(10) Patent No.: US 9,291,088 B2
(45) Date of Patent: Mar. 22, 2016

(54) PISTON ASSEMBLY

(71) Applicant: Samyoung Machinery Co., Ltd., Chungcheongnam-do (KR)

(72) Inventor: Geum Tai Han, Daejeon (KR)

(73) Assignee: Samyoung Machinery Co., Ltd., Chungcheongnam-do (KR)

( * ) Notice: Subject to any disclaimer, the term of this patent is extended or adjusted under 35 U.S.C. 154(b) by 0 days.

(21) Appl. No.: 14/311,611

(22) Filed: Jun. 23, 2014

(65) Prior Publication Data

US 2015/0000618 A1 Jan. 1, 2015

(30) Foreign Application Priority Data

Jul. 1, 2013 (KR) ..... 10-2013-0076354

(51) Int. Cl.

| | |
|---|---|
| ***F01P 1/04*** | (2006.01) |
| ***F01P 3/10*** | (2006.01) |
| ***F02F 3/00*** | (2006.01) |
| ***F02F 3/22*** | (2006.01) |
| *F01M 1/08* | (2006.01) |
| *F02B 3/06* | (2006.01) |
| *F01P 3/08* | (2006.01) |

(52) U.S. Cl.

CPC ..... *F01P 3/10* (2013.01); *F02F 3/0015* (2013.01); *F02F 3/0023* (2013.01); *F02F 3/0076* (2013.01); *F02F 3/22* (2013.01); *F01M 1/08* (2013.01); *F01P 3/08* (2013.01); *F02B 3/06* (2013.01); *F05C 2201/021* (2013.01)

(58) Field of Classification Search

CPC ..... F01P 3/08; F02F 3/22; F02M 1/08; F02B 3/06; F05C 2201/021

USPC ..... 123/41.35

See application file for complete search history.

(56) References Cited

U.S. PATENT DOCUMENTS

| | | | |
|---|---|---|---|
| 2003/0188633 A1 | 10/2003 | Griffiths et al. | |
| 2011/0041684 A1 | 2/2011 | Kortas et al. | |

FOREIGN PATENT DOCUMENTS

| | | | |
|---|---|---|---|
| CH | 326687 | 12/1957 | |
| CH | GB 1166972 A * | 10/1969 | ..... F01P 3/10 |
| DE | 10-2006-055251 | 5/2008 | |
| GB | 1230535 | 5/1971 | |
| KR | 10-2007-0033442 | 3/2007 | |
| KR | 10-2008-0080630 | 9/2008 | |
| KR | 10-2010-0127449 | 12/2010 | |
| WO | WO-2005-121537 | 12/2005 | |

OTHER PUBLICATIONS

European Search Report mailed Nov. 26, 2014 for EP 14175043.

* cited by examiner

*Primary Examiner* — Lindsay Low
*Assistant Examiner* — Charles Brauch

(57) ABSTRACT

A piston assembly includes: a piston skirt; and a piston crown formed by a casting method and coupled to an upper portion of the piston skirt by using a stud bolt, wherein oil galleries are formed between an upper wall of the piston skirt and an upper wall of the piston crown, wherein an annular part having a circular ring shape and a plurality of ribs having a linear shape and radially arranged to form oil channels for flowing cooling oil are formed on the upper wall of the piston crown, and the plurality of ribs are divided into outer ribs and inner ribs by the annular part.

3 Claims, 4 Drawing Sheets

PISTON ASSEMBLY

CROSS-REFERENCE TO RELATED APPLICATION

This application claims priority to and the benefit of Korean Patent Application No. 10-2013-0076354 filed on Jul. 1, 2013, which is herein incorporated by reference in its entirety.

BACKGROUND OF THE INVENTION

1. Field of the Invention

The present invention relates to a piston assembly of a diesel engine, and more particularly, to a piston assembly including a piston crown formed of nodular graphite cast iron and having ribs therein 2. Description of the Related Art In a general internal combustion engine, a piston transmits power to a connecting rod while vertically reciprocating along an inner wall of a cylinder during the intake-compression-combustion-exhaust cycle.

In the case of a high-performance engine, an upper structure (called a piston crown) of a piston including an combustion side and piston ring grooves is exposed to high-temperature, high-pressure combustion conditions during engine operation and is thus manufactured by a forging method for obtaining high-quality mechanical characteristics, while the rest of the piston (called a piston skirt), which is exposed to relatively less severe conditions, is formed of materials such as cast iron. However, if piston crowns are manufactured by a forging method in which a relatively expensive material is used, it is difficult to perform a machining process on the piston crowns. Therefore, the productivity of manufacturing is lowered, and the price of pistons is increased.

In addition, since such a piston crown is inefficiently cooled, the outer diameter of the piston crown may become larger than the inner diameter of a cylinder liner due to thermal expansion during engine operation, and in this case, the piston crown may melt and stick to the cylinder liner. To prevent this, the piston crown and the cylinder liner may be fitted with a large clearance therebetween. However, a large clearance lowers combustion efficiency and thus increases the generation of environmentally harmful pollutants such as fumes or NOx.

In the related art, one-piece pistons are formed by casting a piston crown and a piston skirt with the same material, such as cast iron, and some of such one-piece pistons have ribs formed therein. However, it is difficult to form oil galleries for storing oil in such one-piece pistons due to limitations of casting, and thus the one-piece pistons have low cooling efficiency, thereby generating large amounts of environmentally harmful pollutants like in the case of assembly type pistons formed of forged steel and cast iron. In addition, such one-piece pistons have low degrees of structural strength and are thus not suitable for high-power engines having high combustion pressure.

A method of forming ribs on a piston crown is disclosed in Korean Patent Laid-open Publication No. 2010-0127449. However, the method is for a structure in which a piston assembly is rotated and this application is to enhance the strength of a piston crown in a non-rotating structure is required.

SUMMARY OF THE INVENTION

Aspects of the present invention provide a piston assembly in which a forged piston crown used for the cooling performance and structural strength problems is replaced with a piston crown formed by casting.

Additional aspects will be set forth in part in the description which follows and, in part, will be apparent from the description, or may be learned by practice of the presented embodiments.

According to one or more embodiments of the present invention, a piston assembly includes: a piston skirt; and a piston crown formed by a casting method and coupled to an upper portion of the piston skirt by using a stud bolt, wherein oil galleries are formed between an upper wall of the piston skirt and an upper wall of the piston crown, wherein an annular part having a circular ring shape and a plurality of ribs having a linear shape and radially arranged to form oil channels for flowing cooling oil are formed on the upper wall of the piston crown, and the plurality of ribs are divided into outer ribs and inner ribs by the annular part.

The outer ribs may be higher than the inner ribs,

A lubrication passage may be formed in a center region of the upper wall of the piston skirt.

An annular part corresponding to the annular part formed on the upper wall of the piston crown may be formed on the upper wall of the piston skirt.

The annular part formed on the upper wall of the piston skirt and the annular part formed on the upper wall of the piston crown may be coupled together using the stud bolt.

An oil passage may be formed in the annular part formed on the upper wall of the piston crown or the annular part formed on the upper wall of the piston skirt.

Heights of the outer ribs and the inner ribs may be decreased in directions from a sidewall to a center region of the piston crown.

According to one or more embodiments of the present invention, a piston assembly includes: a piston skirt; and a piston crown formed by a casting method and coupled to an upper portion of the piston skirt by using a stud bolt, wherein oil galleries are formed between an upper wall of the piston skirt and an upper wall of the piston crown, wherein a partial annular part having a partial circular ring shape and a plurality of ribs having a linear shape and radially arranged to form oil channels for flowing cooling oil are formed on the upper wall of the piston crown, and the plurality of ribs are divided into outer ribs and inner ribs by the partial annular part.

Coupling parts may be formed in a center region of the piston crown and a center region of the piston skirt and the coupling parts may be coupled by using the stud bolt. In addition, some of the plurality of ribs which extend to the coupling part formed in the center region of the piston crown and remaining ones of the plurality of ribs which do not extend to the coupling part formed in the center region of the piston crown may be alternately arranged.

A lubrication passage may be formed in the upper wall of the piston skirt at a position apart from the center region of the piston skirt.

A partial annular part corresponding to the partial annular part formed on the upper wall of the piston crown may be formed on the upper wall of the piston skirt.

An oil passage may be formed in the annular part formed on the upper wall of the piston crown or the annular part formed on the upper wall of the piston skirt.

Heights of the plurality of ribs may be decreased in directions from a sidewall to the center region of the piston crown.

BRIEF DESCRIPTION OF THE DRAWINGS

The above and other features and advantages will become more apparent to those of ordinary skill in the art by describing in detail exemplary embodiments with reference to the attached drawings, in which.

In the following description, the same or similar elements are labeled with the same or similar reference numbers.

DETAILED DESCRIPTION

The present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, preferred embodiments of the present disclosure will be described in detail with reference to the accompanying drawings in such a manner that the technical idea of the present disclosure may easily be carried out by a person with ordinary skill in the art to which the invention pertains. Objects, operations, effects, other objects, characteristics and advantages of the present disclosure will be easily understood from an explanation of a preferred embodiment that will be described in detail below by reference to the attached drawings.

Although embodiments have been described with reference to illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims.

Hereinafter, examples of embodiments of the invention will be described in detail with reference to the accompanying drawings such that they can easily be made and used by those skilled in the art.

Figure 1:
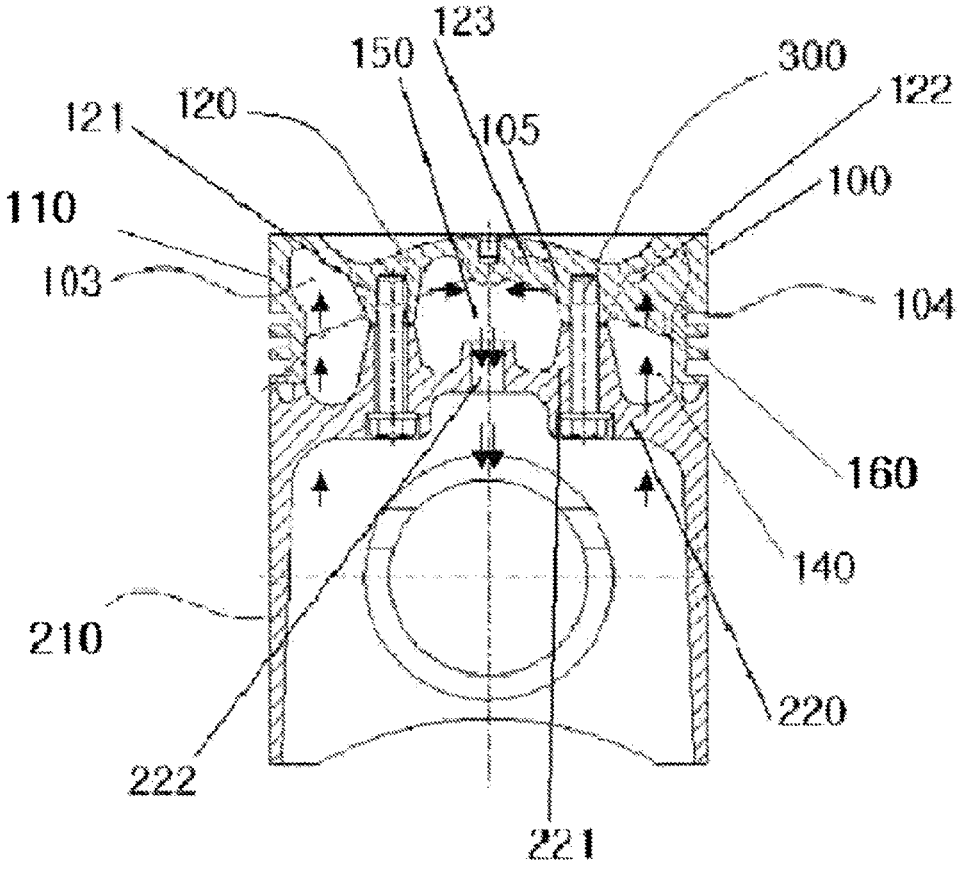
FIG. 1 is a cross-sectional view illustrating a piston assembly according to an embodiment of the present invention.

FIG. 1 illustrates a piston assembly according to an embodiment of the present invention. In the piston assembly, an upper piston crown 100 and a lower piston skirt 200 (refer to FIG. 3) are coupled together using stud bolts 300.

Figure 2:
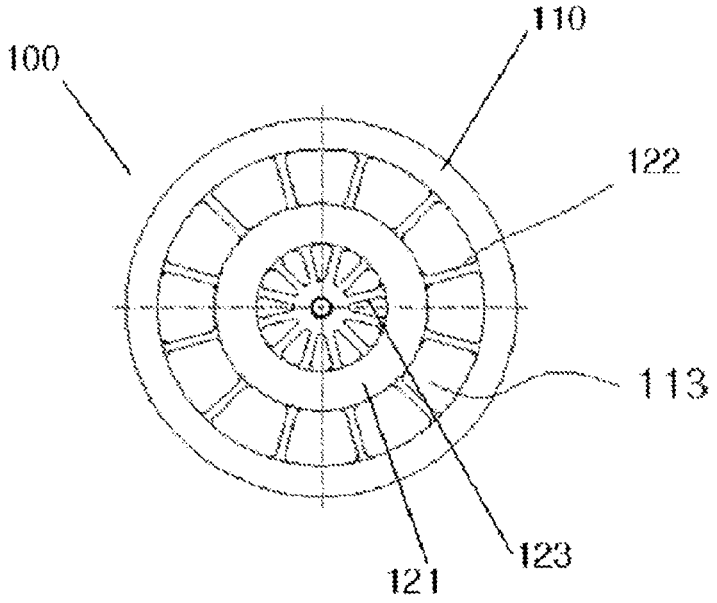
FIG. 2 is a bottom view illustrating a piston crown of the piston assembly illustrated in FIG. 1.

FIG. 2 is a bottom view illustrating the piston crown 100 of the piston assembly illustrated in FIG. 1.

In the embodiment of the present invention, the piston skirt 200 is disposed in an inner wall of a cylinder liner and is configured to move while making frictional contact with the inner wall of the cylinder liner. In addition, the piston crown 100 is assembled on top of the piston skirt 200 so as to be directly exposed to heat and pressure of combustion gas. The piston skirt 200 and the piston crown 100 are coupled together by using the stud bolts 300.

The piston skirt 200 includes a cylindrical sidewall 210 and an upper wall 220, and a circular annular part 221 and a central lubrication passage 222 are formed on the upper wall 220. The annular part 221 makes contact with an annular part 121 of an upper wall 120 of the piston crown 100.

Similarly, the piston crown 100 includes a sidewall 110 and the upper wall 120, and downwardly-extending ribs 122 and 123 and the annular part 121 are formed on the upper wall 120. The annular part 121 has a circular ring shape and makes contact with the annular part 221 of the piston skirt 200.

The piston crown 100 and the annular part 221 of the piston skirt 200 are coupled together by using the stud bolts 300.

In the embodiment of the present invention, the ribs 122 and 123 of the piston crown 100 extend linearly in radial directions and are divided into outer ribs 122 and inner ribs 123 by the annular part 121.

The ribs 122 and 123 form oil channels 130 (refer to FIG. 3) for oil supplied to the inside of the piston assembly.

In FIG. 1, oil supply passages are denoted by arrows. Oil is supplied to an outer oil gallery 140 of the piston crown 100 through a portion of the upper wall 220 adjacent to the sidewall 210 of the piston skirt 200. Then, the oil is supplied to a central oil gallery 150 through oil passage(s) such as oil hole(s) or slot(s) 223 or 124 (refer to FIGS. 3 and 4) formed in the annular part 221 or 121 of the piston skirt 200 or the piston crown 100. Thereafter, the oil is returned to the piston skirt 200 through the central lubrication passage 222 of the piston skirt 200.

Alternatively, oil may be supplied through the oil supply passages in a direction opposite the above-described direction.

Figure 3:
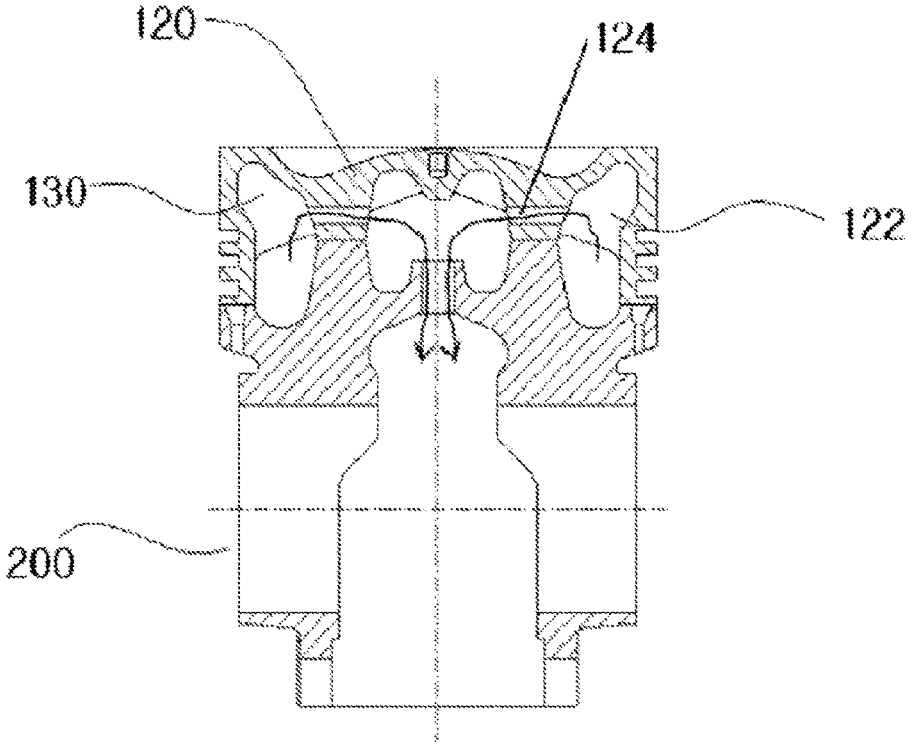
FIG. 3 is a cross-sectional view illustrating oil passages in the piston crown of the piston assembly illustrated in FIG. 1.
Figure 4:
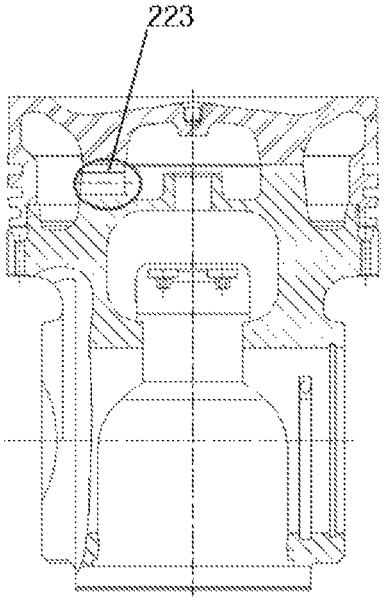
FIG. 4 is a cross-sectional view illustrating oil passages in a piston skirt of the piston assembly illustrated in FIG. 1.

FIG. 3 illustrates oil holes 124 formed in the annular part 121 of the upper wall 120 of the piston crown 100, and FIG. 4 illustrates an oil hole 223 formed in the annular part 221 of the upper wall 220 of the piston skirt 200.

As described above, the ribs 122 and 123 of the piston crown 100 are divided into the outer ribs 122 and the inner ribs 123 by the annular part 121 having a circular ring shape and extending downward from the upper wall 120. The heights of the ribs 122 and 123 are decreased in directions from the outer ribs 122 to the inner ribs 123 (refer to a portion denoted by reference numeral 160 in FIG. 1).

Referring to FIG. 1, reference numeral 160 refers to a line connecting lower ends of the inner ribs 123 and the outer ribs 122. The heights of the ribs 122 and 123 are decreased in a direction along a line 160 toward a center region from the sidewall 110.

In the embodiment of the present invention, as described above, the annular part 221 of the piston skirt 200 supports the annular part 121 of the piston crown 100, and the ribs 122 and 123 of the piston crown 100 support the upper wall 120 of the piston crown 100 as reinforcement structures. Therefore, the piston assembly may be more durable against combustion pressure applied to the piston crown 100.

Furthermore, in the embodiment of the present invention, the ribs 122 and 123 increase the area of the piston crown 100 making contact with cooling oil and function as guides for the cooling oil. That is, the ribs 122 and 123 form the oil channels 130 for smoothly circulating the cooling oil and improving the effect of cooling.

As described above, according to the embodiment of the present invention, the piston assembly has improved structural strength and resistance to thermal stress. Therefore, the piston crown 100 of the piston assembly may be manufactured through a casting process using cast steel, cast iron, or nodular graphite cast iron, and thus the productivity of a manufacturing process and the processability of the piston crown 100 may be markedly improved. However, those of skill in the art will readily recognize, in light of this disclosure, that many different types of materials can be used for dielectric layer. It should be also noted that the method for forming the piston crown 100 is not limited to the above mentioned casting process.

Furthermore, in this case, the oil galleries 140 and 150 and the ribs 122 and 123 may be generated from a material state without having to perform an additional machining process.

Figure 5:
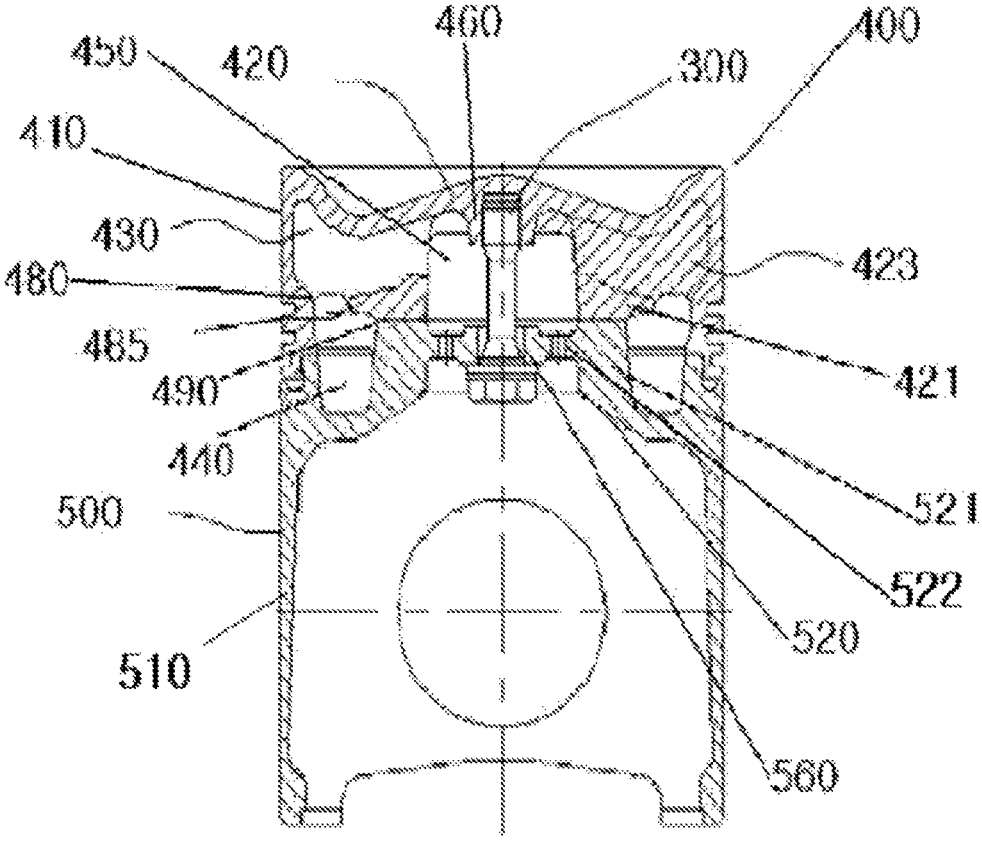
FIG. 5 is a cross-sectional view illustrating a piston assembly according to another embodiment of the present invention.
Figure 6:
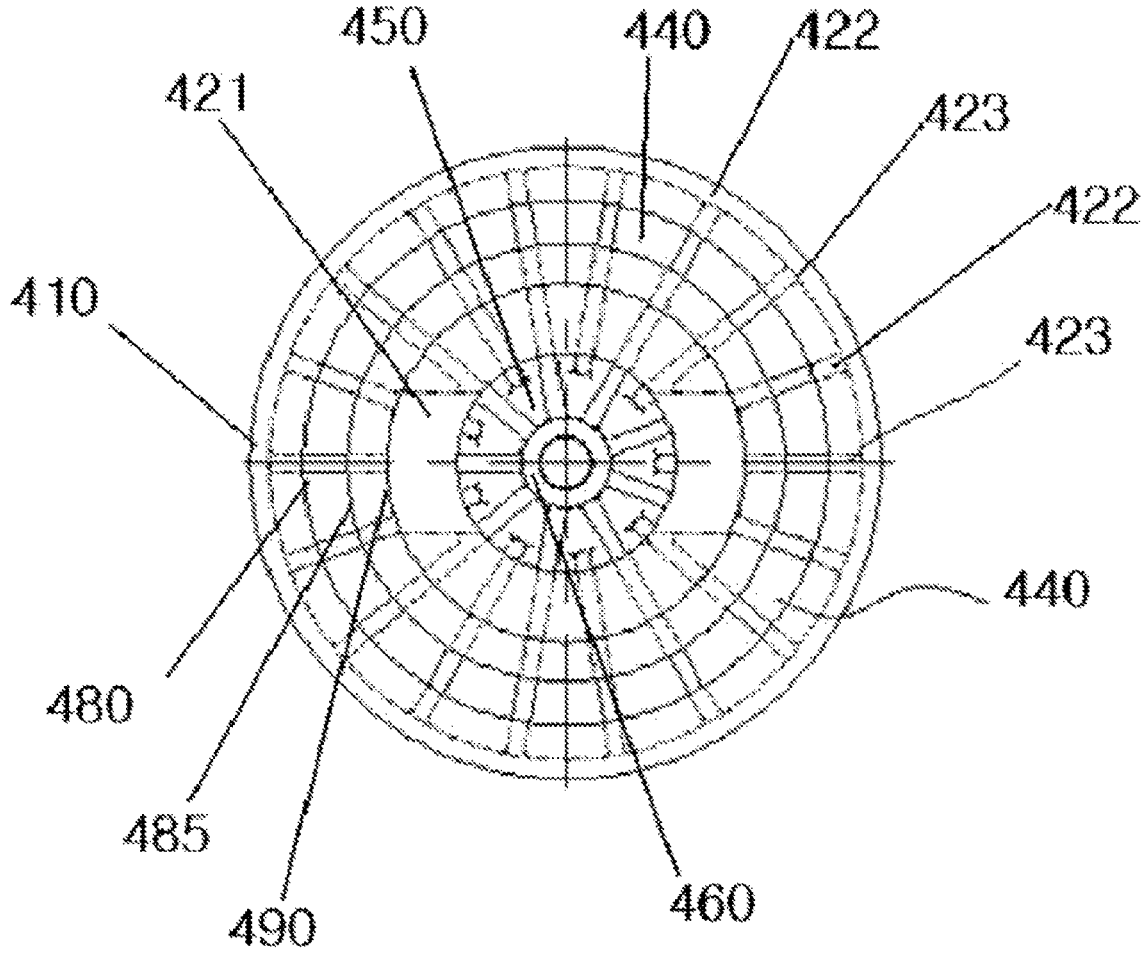
FIG. 6 is a bottom view illustrating a piston crown of the piston assembly illustrated in FIG. 5.

FIG. 5 is a cross-sectional view illustrating a piston assembly according to another embodiment of the present invention, and FIG. 6 is a bottom view illustrating a piston crown 400 of the piston assembly illustrated in FIG. 5.

The piston assembly illustrated in FIG. 5 is different from the piston assembly illustrated in FIG. 1, in that coupling parts 460 and 560 are formed in center regions of the piston crown 400 and a piston skirt 500 for a stud bolt 300, and lubrication passages 522 are formed in the piston skirt 500 at positions apart from the center of the piston skirt 500.

In addition, as shown in the bottom view of FIG. 6, ribs 422 extending to the coupling part 460 formed in the center region of the piston crown 400 and ribs 423 not extending to the coupling part 460 are alternately formed.

Since the distances between the ribs 422 and 423 are decreased in a direction toward the center region, the ribs 422 and 423 are alternatively formed having relatively long and short lengths, respectively. In addition, as shown in FIG. 6, the ribs 422 and 423 are divided into inner and outer ribs by a partial annular part 421 extending from an upper wall 420 of the piston crown 400. The partial annular part 421 has a partial circular ring shape instead of a complete circular ring shape. Those of ordinary skill in the art will recognize that the number and arrangement of the ribs 422 and 423 may be varied in accordance with a particular application thereof, the depiction of the ribs 422 and 423 being exemplary only.

In the piston assembly illustrated in FIGS. 5 and 6, cooling oil may be supplied to an oil gallery 440 through a portion of an upper wall 520 of the piston skirt 500 adjacent to a sidewall 510 of the piston skirt 500, and then may flow along oil channels 430 formed by the ribs 422 and 423 to a center region. Thereafter, the cooling oil may return to the piston skirt 500 through the lubrication passages 522. Alternatively, the cooling oil may be circulated in a direction opposite the above-described direction.

In FIGS. 5 and 6, like reference numerals denote like elements.

As described above, according to the one or more of the above embodiments of the present invention, cooling oil may make contact with a larger area of the piston assembly and may be smoothly circulated in the piston assembly owing to the oil channels, and thus the piston assembly may be cooled more efficiently. In addition, since the radially-arranged ribs function as reinforcement structures for supporting a combustion side (that is, the upper wall) of the piston crown to which combustion pressure is directly applied, the piston crown may become more resistant to combustion pressure.

Therefore, the piston assembly of the embodiments of the present invention may have improved quality, reliability, and a long lifespan as compared with piston assemblies of the related art, and may be applied to high-power engines.

Furthermore, owing to the improved characteristics of the piston assembly, the piston crown may be formed by a casting method instead of a forging method. Thus, the productivity of a manufacturing process of the piston crown may be improved, and the piston crown may be machined more easily.

It should be understood that the exemplary embodiments described herein should be considered in a descriptive sense only and not for purposes of limitation. Descriptions of features or aspects within each embodiment should typically be considered as available for other similar features or aspects in other embodiments.

While one or more embodiments of the present invention have been described with reference to the figures, it will be understood that many variations and modifications of the basic inventive concept herein described, which may appear to those skilled in the art, will still fall within the spirit and scope of the exemplary embodiments of the present invention as defined by the appended claims.

What is claimed is:

1. A piston assembly comprising:

a piston skirt; and a piston crown formed by a casting method and coupled to an upper portion of the piston skirt by using a stud bolt, wherein oil galleries are formed between an upper wall of the piston skirt and an upper wall of the piston crown, wherein a partial annular part having a partial circular ring shape and a plurality of ribs having a linear shape and radially arranged to form oil channels for flowing cooling oil are formed on the upper wall of the piston crown, the plurality of ribs are divided into outer ribs and inner ribs by the partial annular part and the plurality of ribs extend downward from the upper wall, wherein coupling parts are formed in a center region of the piston crown and a center region of the piston skirt, and the coupling parts are coupled by using the stud bolt, wherein some of the plurality of ribs which extend to the coupling part formed in the center region of the piston crown and remaining ones of the plurality of ribs which do not extend to the coupling part formed in the center region of the piston crown are alternately arranged, wherein a lubrication passage is formed in the upper wall of the piston skirt at a position apart from the center region of the piston skirt, and wherein a partial annular part corresponding to the partial annular part formed on the upper wall of the piston crown is formed on the upper wall of the piston skirt.

2. The piston assembly of claim 1, wherein an oil passage is formed in the partial annular part formed on the upper wall of the piston crown or the partial annular part formed on the upper wall of the piston skirt.

3. The piston assembly of claim 2, wherein heights of the plurality of ribs are decreased in directions from a sidewall to the center region of the piston crown.

* * * * *